US005505362A

United States Patent [19]

Marks

[11] Patent Number: 5,505,362

[45] Date of Patent: Apr. 9, 1996

[54] FORWARD ACTING, STAPLE MACHINE WITH PASSIVE RELEASE

[75] Inventor: Joe S. Marks, Los Angeles, Calif.

[73] Assignee: Worktools, Inc., Chatsworth, Calif.

[21] Appl. No.: 461,704

[22] Filed: Jun. 5, 1995

Related U.S. Application Data

[60] Division of Ser. No. 290,088, Aug. 12, 1994, Pat. No. 5,427,299, which is a continuation-in-part of Ser. No. 74,941, Jun. 10, 1993, Pat. No. 5,407,118.

[51] Int. Cl.[6] ..... B25C 5/10

[52] U.S. Cl. ..... 227/120; 227/132

[58] Field of Search ..... 227/132, 127, 227/120, 146

[56] References Cited

U.S. PATENT DOCUMENTS

| | | | |
|---|---|---|---|
| 2,401,840 | 6/1946 | Olson | 227/127 |
| 3,034,128 | 5/1962 | Robbins | 227/132 |
| 3,263,888 | 8/1966 | Wandel | 227/132 |
| 4,150,774 | 4/1979 | Wright | 227/132 |
| 4,640,451 | 2/1987 | Steiner et al. | 227/127 |
| 4,724,992 | 2/1988 | Ohmori | 227/132 |
| 5,165,587 | 11/1992 | Marks | 227/132 |

*Primary Examiner*—Scott A. Smith

*Attorney, Agent, or Firm*—Paul Y. Feng; Poms, Smith, Lande & Rose

[57] ABSTRACT

A manually powered fastening tool that stores and instantly releases the energy of a spring such that it forces a staple or other fastener into an object by an impact blow, wherein the operating handle is hinged near the end of the tool body opposite the end from which the staples exit. A staple ejecting plunger is unstably linked to spring actuating levers such that with the removal of a light holding force, the plunger and actuating levers are de-linked. The tool housing comprises a cantilevered rear profile.

3 Claims, 8 Drawing Sheets

FIG. 5.
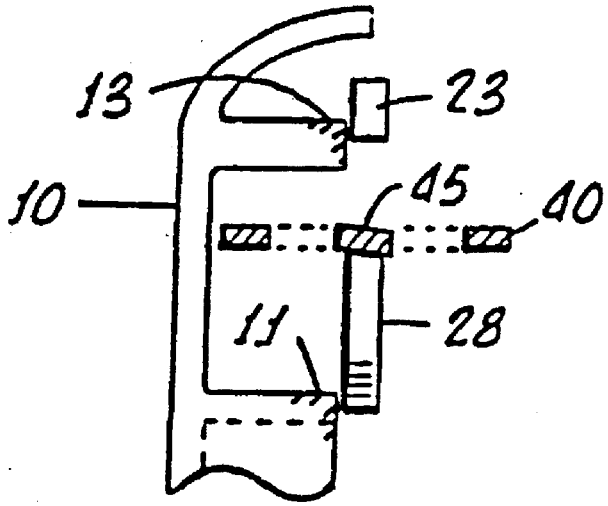
FIG 6.
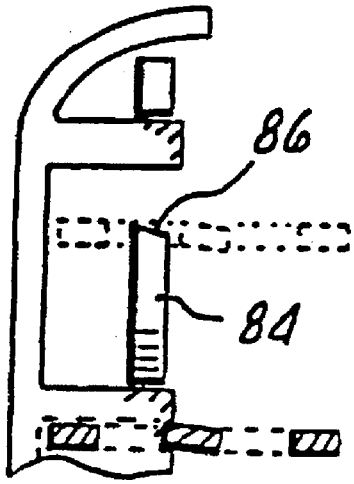
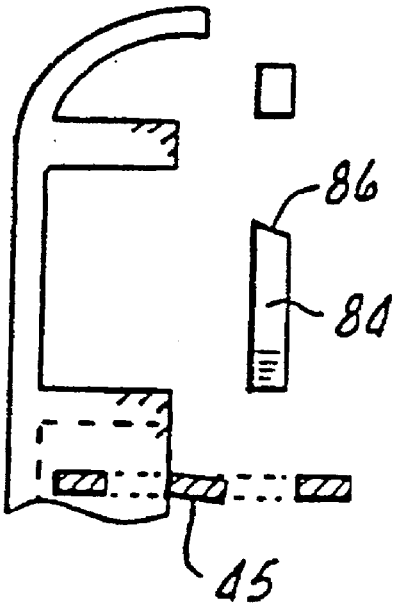
FIG. 7.
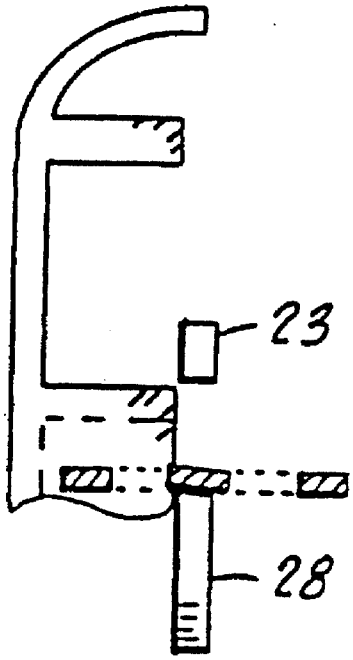
FIG. 8.

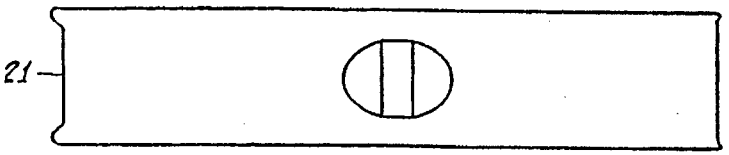
FIG. 13.
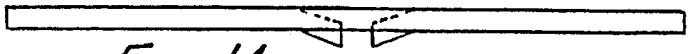
FIG. 14.
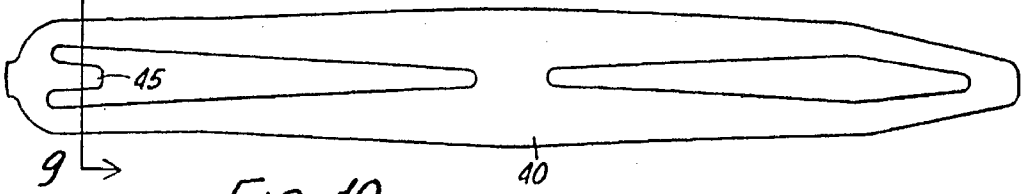
FIG. 10.
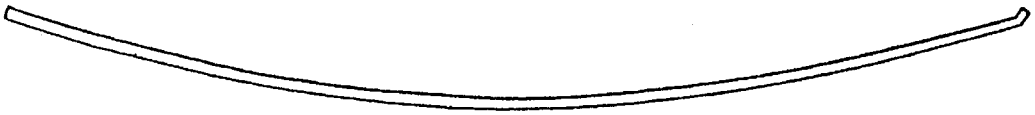
FIG. 11.
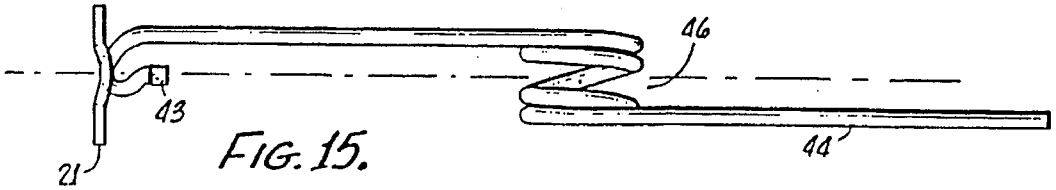
FIG. 15.
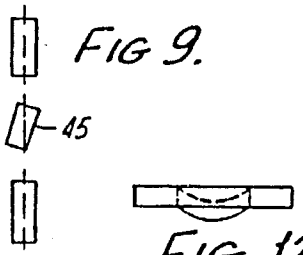
FIG 9.
FIG. 12.

FIG. 18.
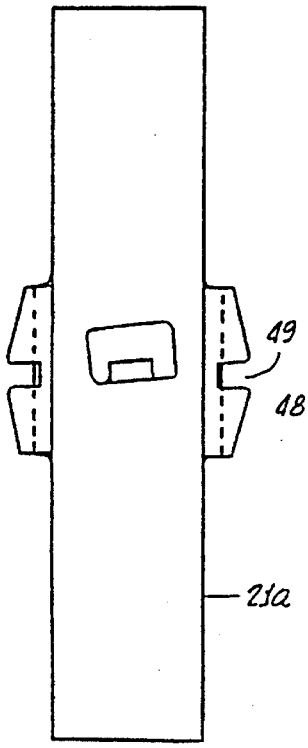
FIG. 17.
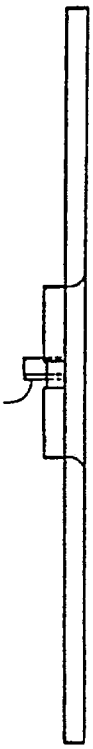
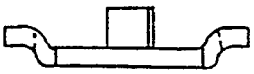
FIG. 16.
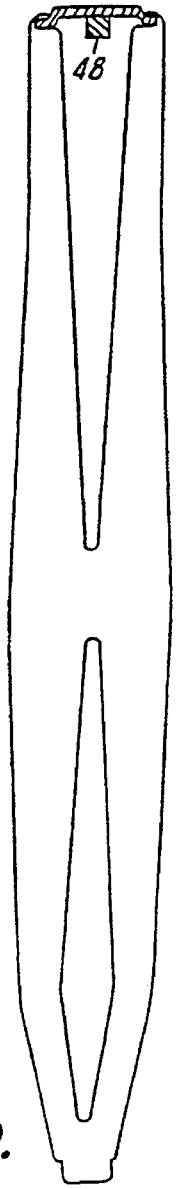
FIG. 20.
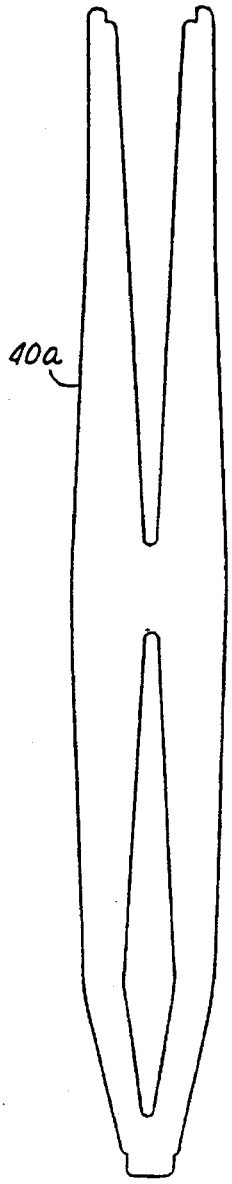
FIG. 19.

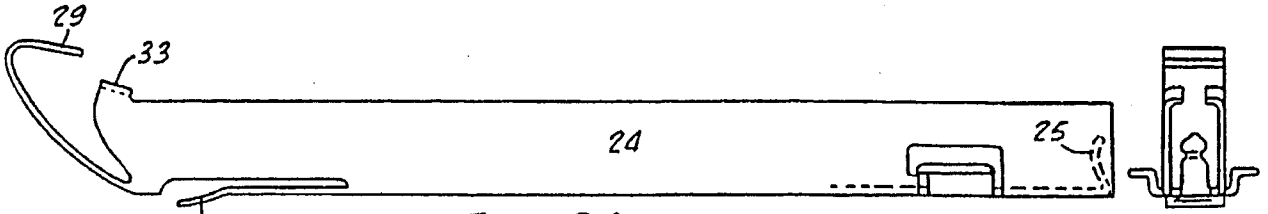
FIG. 21.
FIG. 22.
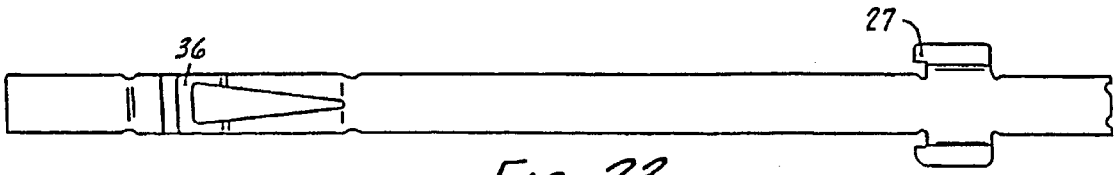
FIG. 23.
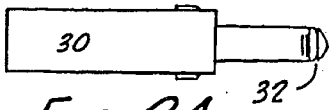
FIG. 24.
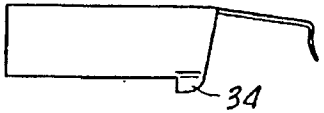
FIG. 25.
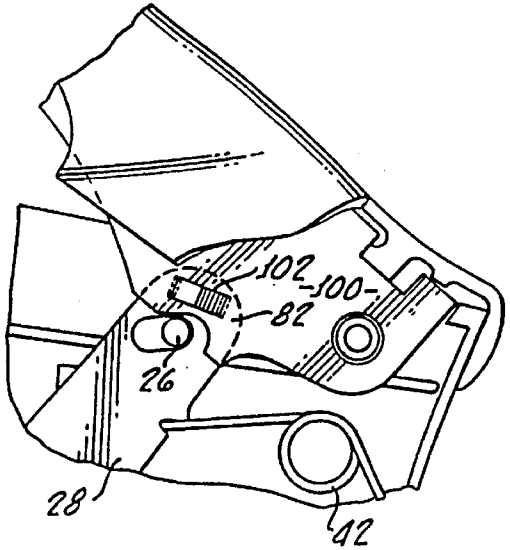
FIG. 26.

FORWARD ACTING, STAPLE MACHINE WITH PASSIVE RELEASE

This is a divisional of application Ser. No. 08/290,088, filed Aug. 12, 1994, now U.S. Pat. No. 5,427,299, which is a continuation-in-part of application Ser. No. 08/074,941, filed Jun. 10, 1993, which issued as U.S. Pat. No. 5,407,118.

BACKGROUND OF THE INVENTION

1. Field of the Invention

The present invention generally relates to manually powered fastening devices, and more specifically to impact driven staple guns and tacking machines.

2. Description of the Related Art

The fastening tool of the present invention is similar to that disclosed in co-pending application Ser. No. 07/899,748, filed Jun. 17, 1992, and U.S. Pat. No. 5,165,587, issued Nov. 24, 1992 to Joel Marks. The fastening tool enables an operator's single hand to compress a spring to store and instantly release the energy of the spring to expel a staple from the fastening tool by an impact blow. The fastening tool incorporates a forward acting actuator lever. The staples exit towards the front end of the fastening tool while the lever is hinged near the rear end of the fastening tool. The tool may be gripped through an opening in the body of the tool. The opening extends to the front of the tool, and in certain configurations, the opening may originate at the front of the body of the tool.

U.S. Pat. No. 2,671,215 issued to Abrams discloses the familiar Arrow stapler. A lever is pivoted towards the front of the staple gun. Pressing down the lever behind the pivot compresses a coil spring and raises a plunger through a pivotally attached actuating arm. At a pre-determined point of the lever travel, the actuating arm has arced rearward sufficiently such that it releases the plunger assembly. The plunger is driven downwards by the force stored in the coil spring. The coil spring is located immediately adjacent to, or above, the plunger. The plunger is located in the front of the staple gun.

U.S. Pat. No. 3,610,505 issued to Males discloses a design similar to the Abrams design. A lever is pivoted near the front of a staple gun. Pressing the extended arm of the lever downwards towards the rear of the staple gun causes a coil spring to compress and simultaneously raises a plunger. Once the lever has been lowered past a predetermined point, the lever is released from the coil spring and plunger assembly by the force of a cam assembly, and the force stored in the coil spring is allowed to drive the plunger downwards, striking and ejecting a staple. The plunger is located at the front of the staple gun.

U.S. Pat. No. 2,326,540 issued to Krantz discloses a staple gun in which the actuation lever is pivoted towards the rear of the staple gun. Through a series of levers, this action is connected to a coil spring and plunger located at the front of the staple gun. As the lever arm is lowered, the spring is compressed and the plunger is raised. A pivotable member of the spring and plunger assembly links the levers to the assembly. Once the lever reaches a predetermined point, the pivotable member is forcibly disengaged from the lifting lever, and the energy stored in the coil spring is allowed to release, driving the plunger downward, striking and expelling a staple.

U.S. Pat. No. 2,769,174 issued to Libert describes a staple gun in which the actuation lever is pivoted at a point towards the rear of the staple gun, and staples are expelled out of the front of the staple gun. Pressing down on the actuation arm towards the bottom of the staple gun actuates a series of levers and compresses a coil spring to raise the plunger. At a predetermined point, two of the levers are forcibly decoupled and the energy stored by the coil spring is allowed to release, driving the plunger downwards, striking and expelling a staple.

U.S. Pat. No. 4,629,108 issued to Judge describes a staple gun contained within a stamped metallic frame which is enclosed in a second stamped or molded housing. Judge describes a common mechanism to accommodate an actuation lever pivoted near the rear of the staple gun. The release mechanism appears to be similar to that of Libert.

U.S. Pat. No. 3,862,712 issued to LaPointe et al. discloses a staple guiding track which slides rearward to expose a chamber in the staple gun body into which staples are placed. The staple gun is inverted during this operation. This sliding mechanism requires numerous components and assembly operations for its manufacture.

U.S. Pat. No. 4,452,388 issued to Fealy comprises a staple gun with an intermediately actuated leaf spring. The multi-layered leaf spring spans the length of the tool body. A mechanism pulls upward upon the spring to lift the spring and plunger. The mechanism is then forced away from the spring to release the spring from the actuating mechanism.

Typical of the prior art, the above described designs use either of two release methods. By one method a cam or stop acts upon a linking member to force a de-linkage at the release position. By the other method a rotating actuating member is slidably linked to a reciprocating plunger member. At the release position the actuating member has rotated out of the plane of motion of the plunger member, and the plunger member is released.

The above release methods may be called active or direct releases because the release is forcibly and directly caused by the actuating members. The first method requires a substantial increase in operating force to enable the forced release action. The second method provides only a vague release action since there is no secondary event to cause the release. No distinct action occurs at the release position.

SUMMARY OF THE INVENTION

The present invention incorporates a passive or indirect release into a forward acting, staple machine. In a preferred embodiment, the staple machine includes a linkage disposed between the operating lever and plunger, which linkage becomes unstable near a release point. The unstable linkage is held in place by the light force from a further component. In a preferred embodiment, the further component is a ledge or tab extending inward from the tool housing wall to form a release surface. This release surface serves to slidably guide the unstable linkage with a force just great enough to hold the linkage together. At the release point, the ledge or tab is no longer present to guide the linkage and the linkage separates.

The passive release therefore uses a distinct secondary event to cause de-linkage without requiring increased operating force. In one embodiment of the present invention, the actuating lever engages a cantilevered tab extending from the spring. The spring comprises a variable cross section flat torque transmitting spring, a coiled wire torsion spring, or similar type spring known in the art.

Those springs differ from the leaf spring taught in U.S. Pat. No. 4,452,388 issued to Fealy, for example, in that they allow an efficient distribution of stress along the spring length with the use of only one component. The actuating system of the above embodiments differs from Fealy in that the engagement surface is a cantilevered, rearward facing tab; the tab is not part of the live spring.

In another alternative embodiment of the present invention, the engagement tab is part of the plunger. The actuating lever and spring are linked through the plunger, with the linkage points substantially aligned across the width of the plunger.

Rather than the usual forward to back release motion, the present design provides a sideways motion of the actuating lever to effect the release of the spring and plunger assembly. Such motion occurs by wobble about two attachment points of the actuating lever and hence requires no front to back sliding of the lever. The sideways wobble thereby reduces friction during the release action.

The housing shape of the present invention provides two features to improve the function of the invention. One feature comprises an overhung or cantilevered back end. The upper rear portion of the housing extends back farther than the lower rear portion. The cantilevered back end provides a more rearwardly hinged operating lever while reducing the material required for the housing, since only the upper rear portion extends back to accommodate the lever hinge. A further feature of the cantilevered back end is to communicate the direction to operate the tool. A back so shaped is unlikely to be mistaken for the front end.

A second feature of the housing comprises an intermediate finger stop across the grip opening. The middle, or longest, finger may support the tool by this finger stop, especially when the tool is used vertically. The middle finger has the greatest ability to extend the tool body away from the operating handle and the intermediate finger stop allows this action.

The return spring serves two functions. First, it provides the, bias to return the operating handle to an initial position. The spring provides a greater return bias in its extended position, with reduced bias in its most contracted position. The handle thereby exhibits a solid return action while the return spring causes the minimum possible resistance during operation of the tool. The second function of the spring is to control wobble of the engagement lever.

It is therefore an object of the present invention to provide a spring actuated fastening device in which the spring is de-linked from an actuating lever through a passive or indirect event. It is a further object of the present invention to provide a cantilevered profile at the lower rear of the tool housing to conserve material and to communicate which end is the rear of the tool.

It is still another object of the present invention to provide a means for the longest, middle finger to support and control the weight of the tool. It is yet another object of the present invention to provide a fastening tool with a dual function return spring which gives a return bias to the operating lever and also controls release and engagement functions. It is still a further object of the present invention to provide a fastening tool in which the return spring features varying force to cause a maximum return bias only in the extended position, where it is most needed.

BRIEF DESCRIPTION OF THE DRAWINGS

FIGS. 2(*b*) and 2(*c*) is a view of the segmented pads for enhancing the motion of the wobble lever.

FIG. 5 is a view, partly in section, of the fastening tool of FIG. 1, showing a portion of the tool housing, actuating lever and mainspring front portion. The lever is near the release position.

FIG. 6 is the view of FIG. 5, with the lever moved sideways to its release position, the spring shown in phantom in its uppermost position and in solid section in its lower position.

FIG. 7 is the view of FIG. 6, with the lever moved sideways past center, aligned so the lever may pass through the plane of the spring front end.

FIG. 8 is the view of FIG. 7, with the lever in an initial position below the spring.

FIG. 9 is the section of the mainspring of FIGS. 5 through 8.

FIGS. 10 & 11 are plan and side elevations, respectively, of the complete spring of FIG. 9.

FIGS. 12, 13 and 14 are end, side and plan elevations, respectively, of a plunger which mates with the spring of FIGS. 9 through 11.

FIG. 15 is a view of a torsion spring alternative to the flat spring of FIGS. 9 through 11, engaging the plunger of FIGS. 12 through 14.

FIGS. 16, 17 & 18 are end, side and plan elevations, respectively, of a plunger according to a further embodiment.

FIG. 19 is a plan elevation of an open ended flat spring.

FIG. 20 is an elevation of the flat spring of FIG. 19, mated with the plunger of FIGS. 16, 17 & 18.

FIGS. 21, 22 & 23 are side, front & bottom elevations, respectively, of a loading track.

FIGS. 24 & 25 are top and side elevations of a staple feeder.

FIG. 26 is a partial view showing the back end of the handle base having punched lances against which the lever pivots.

DETAILED DESCRIPTION OF THE INVENTION

Figure 1:
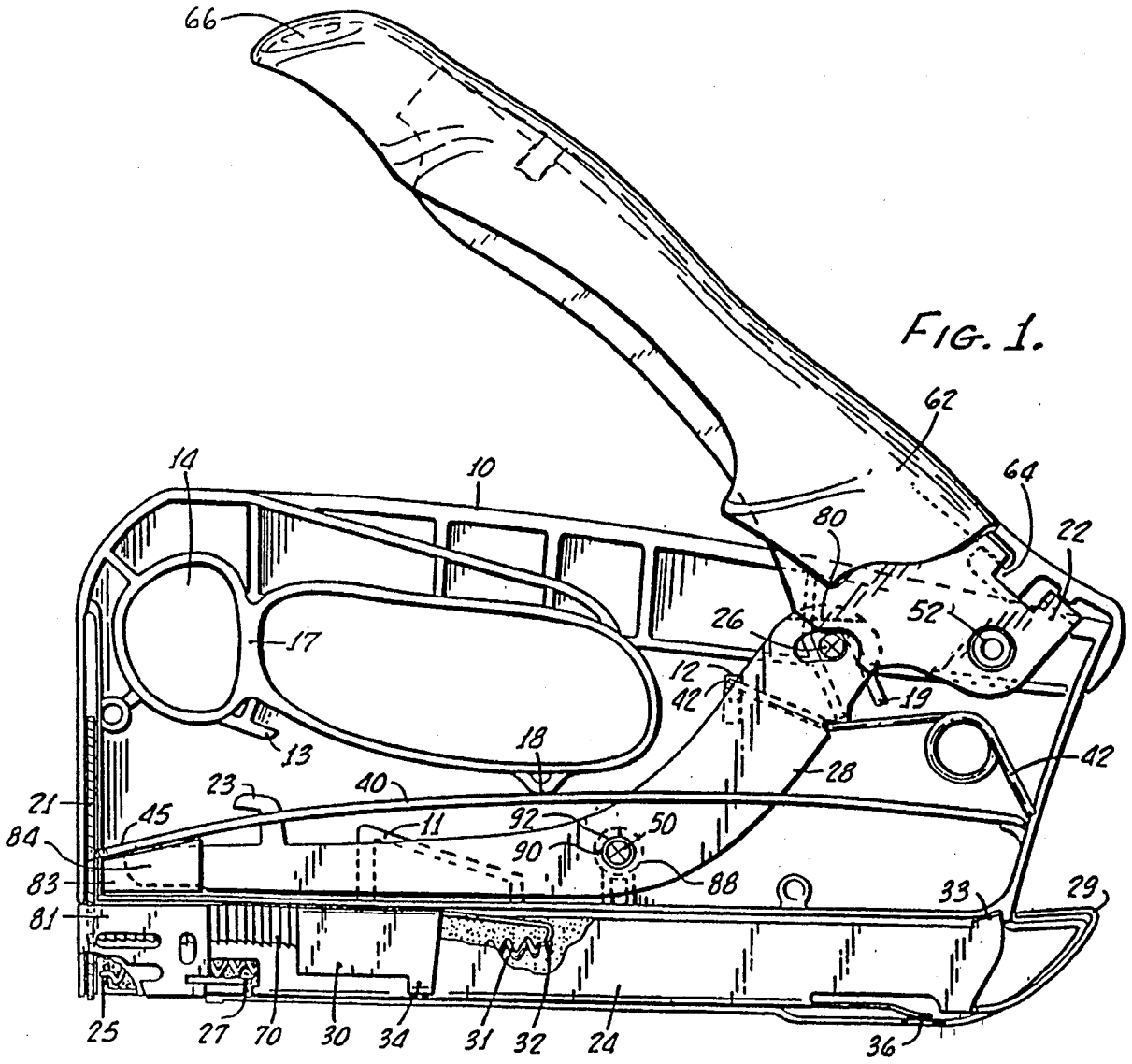
FIG. 1 is a side elevation of a fastening tool, with one half of the housing removed, with its grip handle in an extended position and spring in its rest state, as the tool would appear before commencing an operating sequence.

FIG. 1 shows a preferred embodiment of the present invention. In FIG. 1, die-cast metal housing 10 preferably consists of two opposing halves joined together to contain, guide and hold the internal components of the fastening tool in a predetermined position. Opening 14 in die cast housing 10 is provided to receive the index finger of a hand as it grips the fastening tool. Finger stop 17 provides a surface for the middle finger to support the tool when the tool is held vertically. Molded handle cover 62 provides a thumb rest surface 66 to accommodate the thumb of a user's hand.

Pivot 52 is a post near the rear of housing 10 and is part of housing 10. Handle cover 62 fits over, and covers the top portion of, lever 22. Roller linkage 26 provides a frictionless connection between levers 22 and 28. Lever 28 pivots about pin 50.

At a back end 82 of the lever 28 is preferably an out-of-plane bend 80 represented by dashed line of FIG. 1. The out-of-plane bend 80, which in FIG. 1 leans out of the page, gives the lever 28 adequate clearance when the lever 28 undergoes its wobble action described in more detail below.

Pin 50 is identical to roller linkage 26. As lever 22 is displaced downward, lever 22 acts increasingly tangentially through roller linkage 26, relative to pin 50. This causes increasing leverage upon lever 28 through the displacement of lever 22 and deflection of spring 40. Hence the force required to operate lever 22 through its full displacement is relatively constant.

Preferably, a single, varying cross-section, flat spring 40 spans the length of housing 10. Spring 40 has a maximum effective width at fulcrum support 18, becoming optionally narrower toward each end. The entire spring length therefore provides energy storage.

Lever 28 is linked to the front of spring 40 through two possible means. By one embodiment (FIG. 10) lever 28 engages rearward extending tab 45, with tab 45 attached to the front portion of spring 40. In another embodiment (FIG. 20) lever 28 engages rearward extending tab 48 of plunger 21*a*. In this design (FIGS. 18, 19), spring 40*a* is linked to plunger 21*a* through slots 49 of plunger 21*a*, where slots 49 are substantially aligned with tab 48 across plunger 21*a*. Such alignment prevents front to back motion at the plunger to spring and lever linkages from causing rotational forces upon plunger 21*a*.

In an alternate spring design, coiled bar torsion spring 44 (FIG. 15) fits around a post within housing 10. Gap 46 is provided to allow additional clearance for lever 28. Tab 43 extends rearward to engage lever 28 similarly to tab 45 of spring 40, including the angle similar to that shown in FIG. 9.

FIGS. 5, 6, 7 and 8 show an action according to the first preferred embodiment above (FIGS. 9–14). However, the configurations of FIGS. 15 and 19 may also be described by FIGS. 5 through 8.

In FIGS. 5 and 8, lever 28 is lifting tab 45. Tabs 43, 45 or 48 are preferably angled to lightly force or bias lever 28 and tab 23 thereof into release ledges 11, respectively, and 13 in a sliding engagement. As lever 28 continues upward, the bottom surface of lever 2, including the bottom of upper release tab 23, passes above release ledges 11 and 13. The angle in tab 43, 45 or 48 then pushes lever 28 aside and the spring 40 through natural springback is free to travel downward. Lever 28 is free to move aside through wobble about the axis formed by pins 50 and 26.

In order to minimize drag by the angled tab 43, 45 48 when it de-links from the lever 28, the front end 84 of lever 28 has an optional canted contact surface 86, best seen in FIGS. 5–8. Specifically, as shown in FIG. 5, the canted contact surface 86 at the front end 84 of lever 28 generally matches the slope of the angled tab 43, 45 or 48. As the lever 28 clears ledges 11 and 13, the angled tab 43, 45, or 48, benefitting from the canted contact surface 86, slides off smoothly without drag or binding. In an alternative embodiment, the canted contact surface can be a rounded edge.

The wobble motion of the lever 28 should be apparent from a close inspection of FIGS. 5–8. As mentioned earlier, the out-of-plane bend 80 provides clearance at the back end 82 of the lever 28 for lateral movement. That is, the wobble action is facilitated when the back end 82 clears the handle base 100 due to the out-of-plane bend 80.

Alternatively, the handle base 100 can be modified to have a channel into which the back end 82 of lever 28 fits, as shown in FIG. 26. In this embodiment, the wobble action is accommodated by making the channel large to permit wobbling lateral motion of the lever 28, and by forming punched, inward-extending lances 102 or indentations within the outside walls forming the channel. The back end 82 of lever 28 then pivots against the lances 102.

Figure 2A:
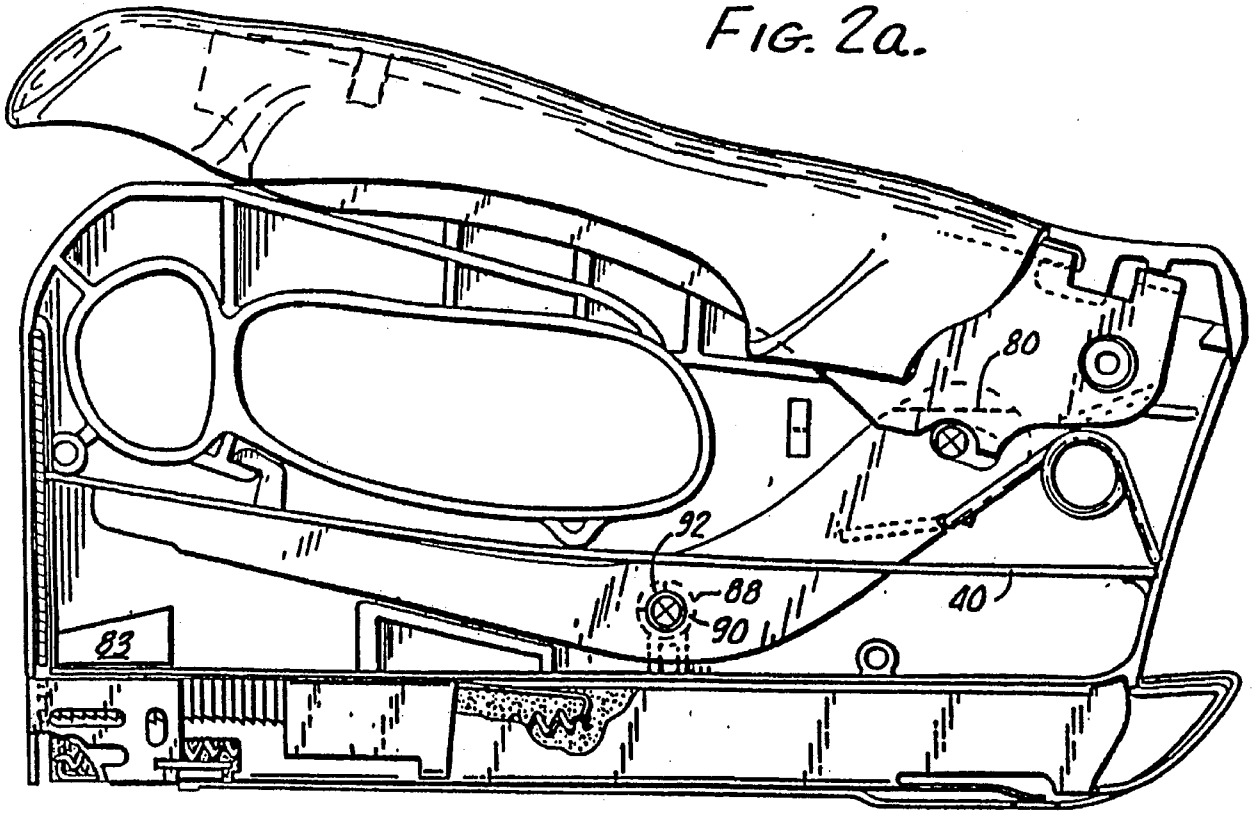
FIG. 2(*a*) is a side elevation of the fastening tool of FIG. 1, with the grip handle fully drawn toward the tool body and spring energized as the tool would appear just prior to ejection of a staple.
Figure 2B:
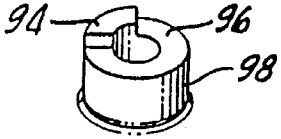
Figure 2C:
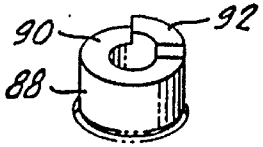

To enhance the wobble motion of the lever 28, the boss 88 in which the pin 50 is mounted and against which the lever 28 moves further comprises a contact surface 90 that preferably has a raised segmented pad 92. This is shown in FIGS. 2(*a*)–2(*c*). The raised segmented pad 92 provides a pivot point to enhance the wobble action of the lever 28, thus avoiding seizing or dragging of the lever 28 against the surfaces of the bosses 88, 98.

There is a segmented pad 92, 94 situated in a boss 88, 98 corresponding to each half of the housing 10. The segmented pads 92, 94 are thus mirror images of each other and retain the lever 28 therebetween, as depicted in FIGS. 2(*b*) and 2(*c*). Further, in the preferred embodiment shown in FIG. 2(*b*), the segmented pad 94 of one boss 98 does not extend to the outer circumference of the contact surface 96, giving the lever 28 greater clearance to pivot. Segmented pad 92 is also located at about the same quadrant as the opposing segmented pad 94. Naturally, the segmented pads 92, 94 can have a variety of inside and outside diameters, depths, and shapes, depending upon the desired pivoting and wobbling motion of the lever 28.

Figure 3:
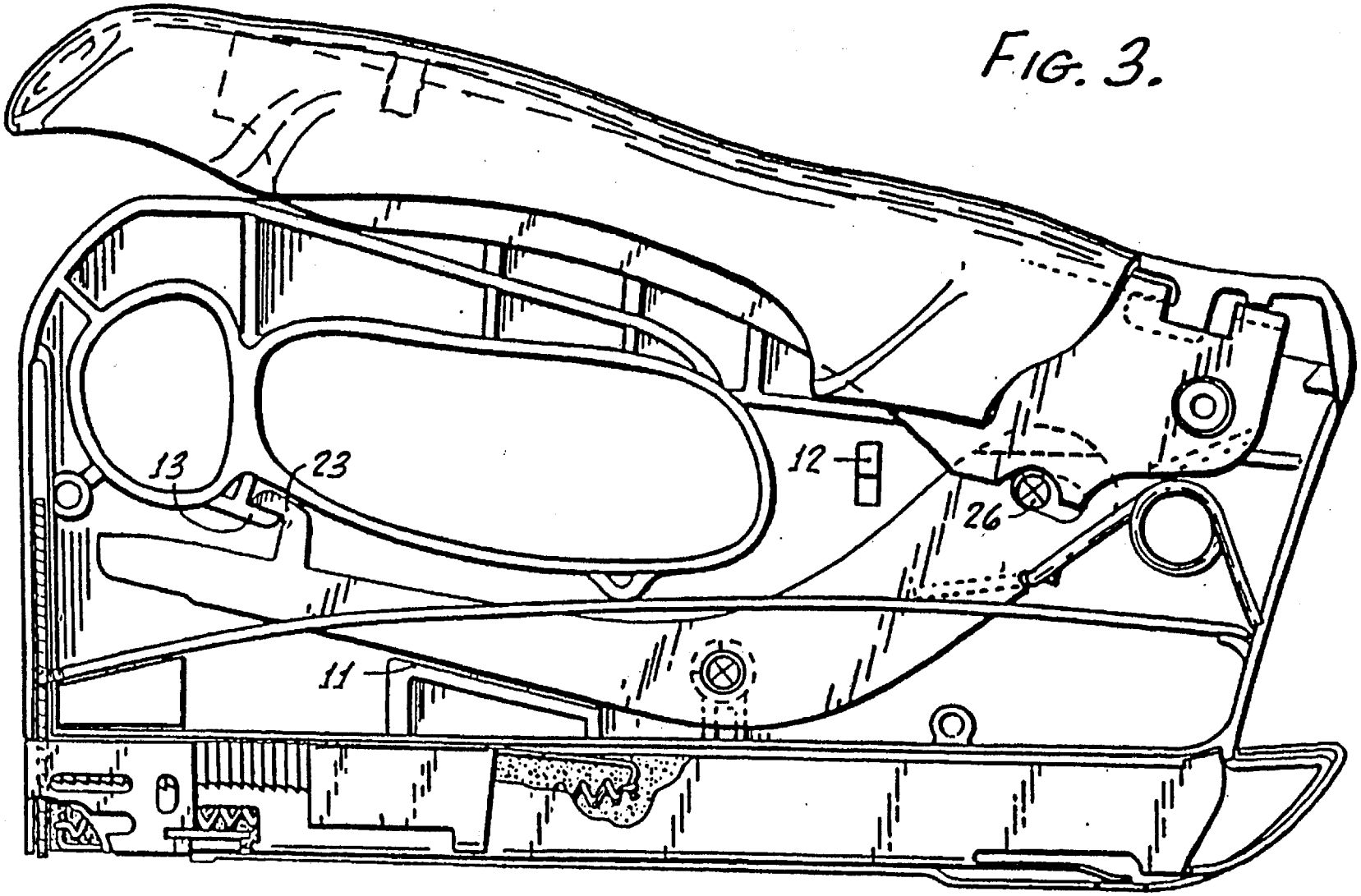
FIG. 3 is a side elevation of the fastening tool of FIG. 1, with the spring in its rest state and the handle fully drawn toward the tool body, as the tool would appear just after ejection of a staple.

Spring 42 is mounted at an off angle and out of plane to the length of lever 28 and tends to push into the page, conceptually speaking, on the back of lever 28 in FIG. 3. The front of lever 28 then moves out of the page, conceptually speaking, in FIG. 3, or to the right to the configuration of FIG. 7. At this point, lever 28 is free of tab 43, 45 or 48 and not impeded by ledges 11 and 13. Next, the mechanism returns to the configuration of FIGS. 1 and 8.

As the back of lever 28 rises during the return stroke, the forward end of spring 42 is pushed away by protruding cam 12 of housing 10. The forward portion of spring 42 is behind lever 28 in FIGS. 1–4. Spring 42 pivots within a notch at the back edge of lever 28. This force more than counteracts the off angle force operating in FIG. 7 and causes the wobble bias upon lever 28 to reverse so that the front of lever 28 will be repositioned under tab 43, 45 or 48. Lever 28 clears tab 45, from FIG. 7 to 8, because cam 12 does not engage spring 42 until lever 28 is beside tab 45. The resilience of the front extension of spring 42 allows spring 42 to deflect against cam 12 before lever 28 can move Under tab 43, 45 or 48.

Spring 42 provides a maximum handle return bias in the initial position (FIG. 1). In this manner the return spring does not resist the operator unnecessarily when the handle is squeezed inward.

Upper release ledge 13 engages release surface 23. This release supplements lower release ledge 11. Upper release 13 is especially effective since it is near the farthest location from the wobble axis defined by pins 50 and 26. Release 13 thereby provides a precise control effect at the front of lever 28.

The above release system is a passive indirect release. Lever 28 is unstable under tab 43, 45 or 48 and slides out from under the tab once lever 28 is clear above ledges 11 and 13. Light sliding pressure between lever 28 and ledges 11 and 13 causes the only friction of the release system.

Figure 4:
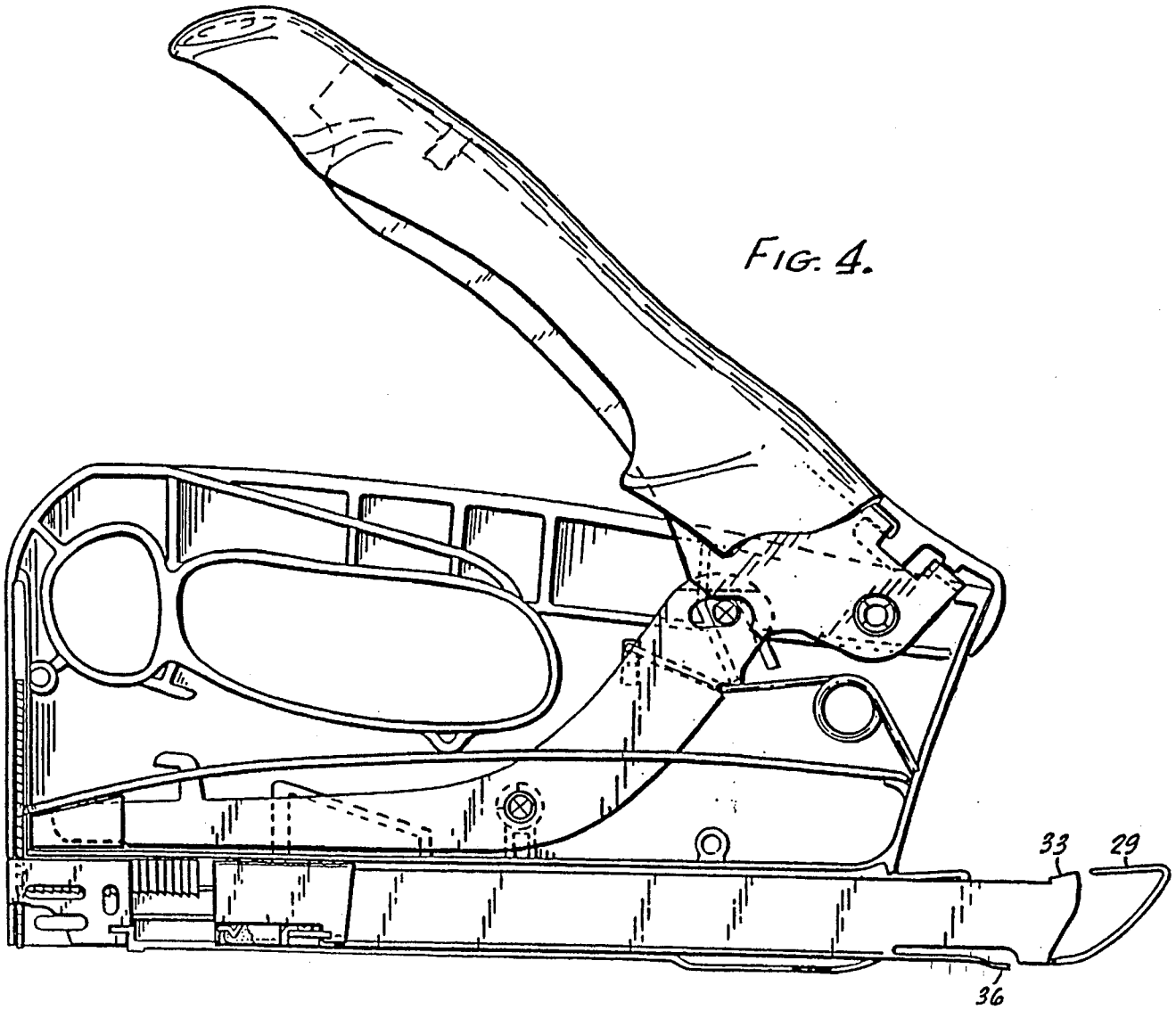
FIG. 4 is a side elevation view of the fastening tool of FIG. 1, with the staple loading track drawn rearward to expose the staple loading channel.

Loading track 24 is retained within housing 10 by the combined effect of latch 33 and integral spring 36. Pressing down on surface 29 causes loading track 24 to move downward against the bias of spring 36 to lower latch 33 out of a recess within housing 10. Loading track 24 is then free to slide rearward as shown in FIG. 4. Staples 70 may then be loaded into housing 10 in front of loading track 24. Staple feeder 30 is drawn to its most forward position on loading track 24 by extension spring 31. Spring 31 is attached at one end to tab 25 at the front of loading track 24, and at the other end to extended tab 32 of feeder 30. Flared tab 34 of feeder 30 (FIG. 25) fits within and below rearward extending tab 27 (FIG. 23) of loading track 24 in the position of FIG. 4. Track 24, spring 31 and feeder 30 are held together this way to aid in pre-assembly.

Nose piece 81 guides staples as they are ejected and prevents wear from staples contacting the zinc housing. Shock absorber 83 limits the travel of the spring/plunger assembly.

There has been described here and above a novel fastening device. Those skilled in the art may now make numerous uses of the teachings of the present invention without departing from the spirit and teachings of the present invention which are defined by the scope of the following claims.

What is claimed is:

1. A fastening device comprising:

a housing having a front, back, and bottom;

a fastener guide track slidably attached to said housing near said bottom, made substantially of a sheet metal form;

fasteners disposed on said guide track;

a further element slidable along said guide track, biased to press against said fasteners on said guide track to bias said fasteners to move along said guide track;

said guide track having a first and second position, sliding between said first position being along the bottom of said housing, and said second position extending rearward of said housing to expose an elongated cavity in the bottom of said housing to receive fasteners;

a latching means for holding said guide track from sliding out of said first position;

wherein said latching means includes a spring engagement means;

wherein said spring engagement means includes an integral resilient spring portion of said sheet metal form; and wherein said spring portion slidably engages a surface of said housing urging said guide track into contact with a latching surface of the housing to lock the guide track in said first position.

2. The fastening device of claim 1, wherein said resilient spring portion comprises an elongated element fixedly attached to said guide track at a first end and freely cantilevered at a second distal end, and said slidable engagement occurs at said distal end.

3. A fastening device comprising:

a housing having a front, back, and bottom;

a fastener guide track slidably attached to said housing near said bottom, made substantially of a sheet metal form;

fasteners disposed on said guide track;

a further element slidable along said guide track; biased to press against said fasteners on said guide track to bias said fasteners to move along said guide track;

said guide track having first and second positions, sliding between said first position being along the bottom of said housing, and said second position extending rearward of said housing to expose an elongated cavity in the bottom of said housing to receive fasteners;

a latching means for preventing said guide track from sliding out of said first position, said latching means including a tab disposed on said guide track and a notch disposed on said housing;

a resilient spring portion integral with said sheet metal form of the fastener guide track;

wherein said spring portion slidably engages a surface of said housing urging said tab on said guide track into engagement with said notch of said housing to lock the guide track in said first position.

* * * * *